US007692510B2

(12) United States Patent
Lasky

(10) Patent No.: US 7,692,510 B2
(45) Date of Patent: Apr. 6, 2010

(54) INTEGRAL VARIABLE TERMINATION FOR ALARM SYSTEM DEVICES

(76) Inventor: Mark A. Lasky, 2340 Woodland La. North, River Woods, IL (US) 60015

( * ) Notice: Subject to any disclaimer, the term of this patent is extended or adjusted under 35 U.S.C. 154(b) by 0 days.

(21) Appl. No.: 11/978,747

(22) Filed: Oct. 30, 2007

(65) Prior Publication Data

US 2009/0108963 A1 Apr. 30, 2009

(51) Int. Cl.
*H01P 1/22* (2006.01)

(52) U.S. Cl. ..... 333/22 R

(58) Field of Classification Search ..... 333/22 R
See application file for complete search history.

(56) References Cited

U.S. PATENT DOCUMENTS 7,012,200 B2 * 3/2006 Moller ..... 200/11 A

* cited by examiner

*Primary Examiner*—Stephen E Jones
(74) *Attorney, Agent, or Firm*—Patent & TMS, P.C.

(57) ABSTRACT

Disclosed is a system for quickly and easily installing end-of-line termination devices at the end of alarm system signal circuits. The termination devices in this invention are both variable and integral to the housing of the alarm system devices. Each alarm system device is constructed with a receptacle at the point of protection, in which may be placed a cartridge, jumper, or similar device on-site to terminate the communication signal. The various embodiments of the invention include a set of devices at discrete values or a variable device to complete each protection loop.

20 Claims, 4 Drawing Sheets

PRIOR ART

INTEGRAL VARIABLE TERMINATION FOR ALARM SYSTEM DEVICES

FIELD OF INVENTION

The invention concerns security systems, including but not limited to burglar, fire alarm, and access control systems, and similar systems. In such systems, protection loops to peripheral devices must be terminated with termination devices. This invention applies particularly to a novel way of installing these termination devices.

BACKGROUND OF THE INVENTION

This invention concerns systems such as burglar, fire alarm, and access control systems, and similar systems, in which peripheral devices are connected to a control panel for monitoring, and the peripheral is terminated with an End-of-Line (EOL) component, which is usually, but not always, a resistor. The EOL component, or termination device, varies both in type and value based on the control panel manufacturers' selections.

In the prior art, an electrician or device installer must manually connect the termination device to the circuit, either by soldering or by connection to a set of electrical terminals or by some other means. This process is tedious, because each termination device must be individually selected and manually installed at remote locations, and as a result many installers simply install the EOL component at the panel, largely defeating its purpose. Hand-installed devices have a tendency to fail, and faulty EOL termination at the panel can cause false alarms on the system or render the protection loop useless by failing to report an alarm state that is present.

Most alarm system faults due to faulty wiring occur in one of two ways: either there is a short circuit on the system because faulty wiring makes contact with grounded components, producing a "short circuit fault", or the contact between system components is broken, resulting in an "open circuit" fault on the system. Both faults are problematic, as most alarm systems see "open circuit" faults as triggered false alarms, while "short circuit" faults can cause an actual alarm to go unreported if the terminating device is installed in the wrong position, i.e. at the control panel.

It is possible to pre-install termination devices within the peripheral devices, but because termination devices vary greatly by manufacturer, it is usually necessary to special-order these devices, which can cause delays and added cost to a project.

The present invention consists of a simpler method of installing termination devices on security system protection loops, reducing the potential for both errors and delays in the process of installing EOL components in such systems.

SUMMARY OF THE INVENTION

The present invention comprises a means of adding a termination device to a peripheral system device directly, by modifying the device itself to accept termination devices of varying types and limited values. The external housing of the peripheral component must be modified with the addition of a coupler connector to accept a jumper, cartridge, or other form of device containing the appropriate EOL component. This connector allows the termination device to be attached directly to the peripheral system device itself, not manually added to the protection loop wiring, and ensures proper connection at the end of the circuit, which in turn ensures full EOL supervision. The invention also allows for field installation of a variety of termination devices, which are designed to couple quickly and effortlessly with the coupler connector prior to installation of the peripheral device.

DETAILED DESCRIPTION OF THE INVENTION

Figure 1:
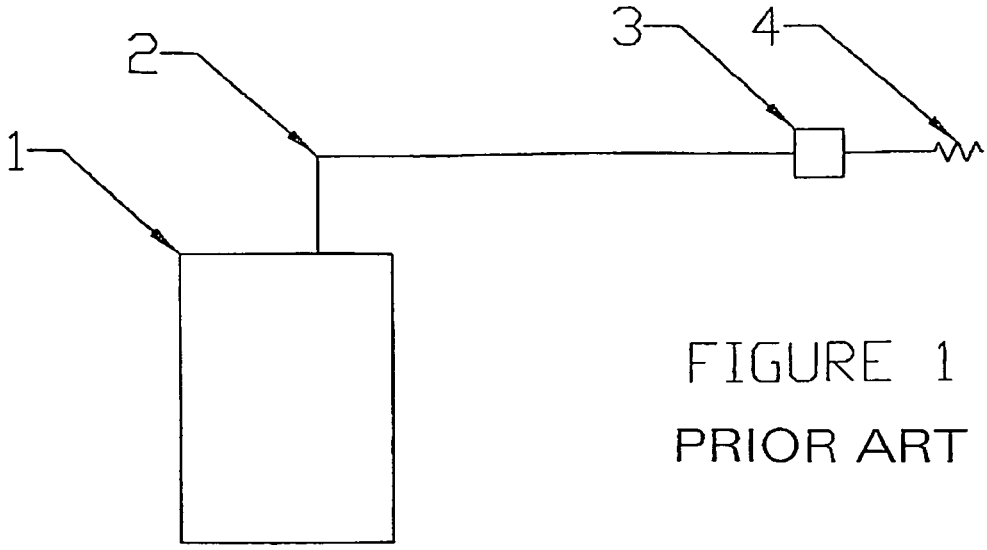
FIGURE 1 PRIOR ART
FIG. 1 depicts a typical alarm system protection loop, with a terminating device at the end of the line.

FIG. 1 depicts the typical alarm system layout in use in the prior art. A signal originates from a control panel (1) and travels down a signal wiring protection loop (2) to one or more peripheral system components (3). The signal is then terminated by a termination device (4), often a manually installed resistor, which is necessary to ensure maximum signal integrity. However, because of the nuisance of installing these devices at multiple remote locations, it is not uncommon for electricians to install termination devices within the control panel (1), which, while functional in a normal state, may cause false alarms or render the entire protection loop useless in the event of an actual alarm if the installation of the termination device is faulty.

Figure 2:
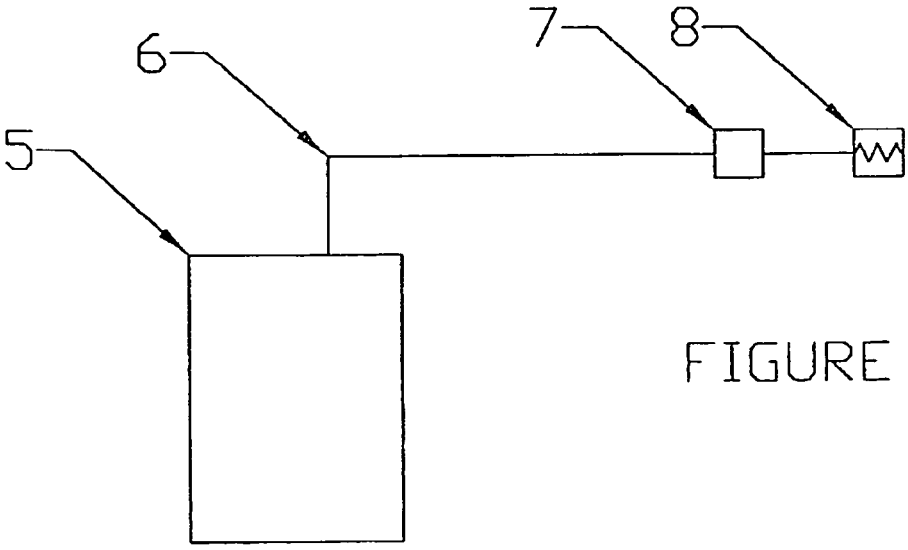
FIG. 2 depicts the proposed alarm system with a terminating device within the peripheral system component furthest from the control panel.

FIG. 2 depicts the proposed alarm system layout using the present invention. Again, the signal originates from a control panel (5) and travels down a signal wiring protection loop (6) and may be received by a number of intermediate peripheral system components (7). However, using the present invention, the terminating device in this circuit is located within the last peripheral system component (8) on the protection loop. Since the installer is going to have to install this peripheral system component (8) anyway, there is no additional work required to terminate the system properly, thus eliminating the temptation to terminate the protection loop in the control panel. (5)

Figure 3:
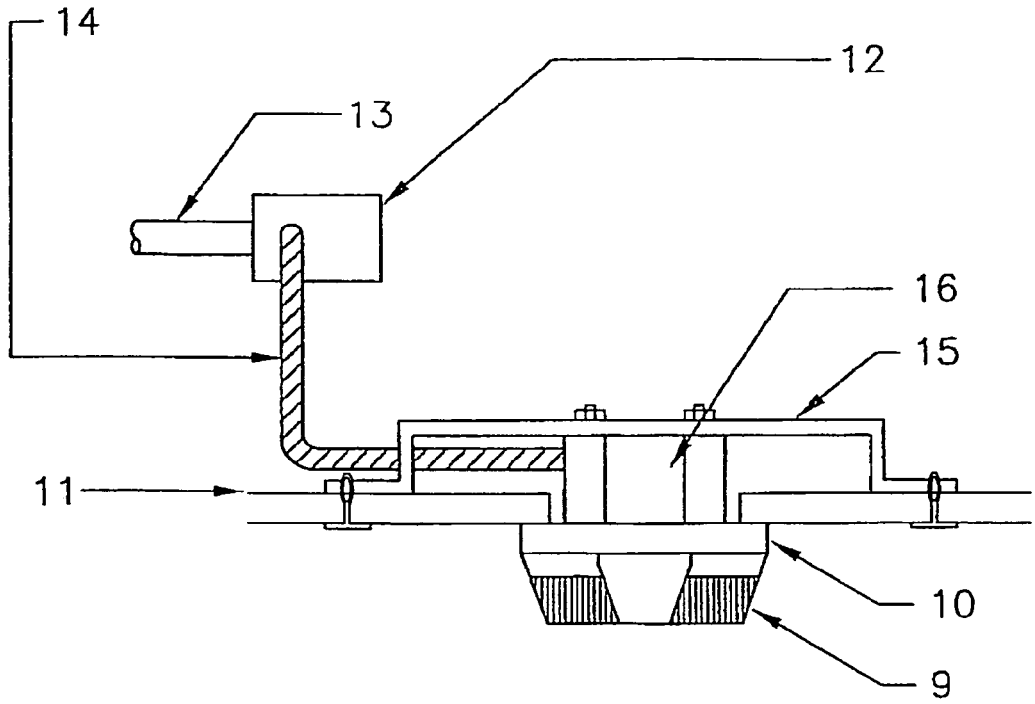
FIG. 3 is a diagram of a typical installation of a peripheral system component.

FIG. 3 depicts a cross section of a typical alarm system peripheral system component installation. In this example, the signal wires are housed in conduit (13) and pass through a junction box, (12) electrical metal tubing, (14) and typically an octagonal junction box (16) to which the peripheral system component (9) is mounted. In many municipalities, conduit, (13) junction boxes, (12) and electrical metal tubing (14) are not required by local codes and are often not installed. The octagonal junction box (16) is typically mounted on a bracket (15) which is attached to the ceiling, (11) and holds the backplate (10) of the peripheral system component flush with the ceiling (11).

The conduit, (13), junction box, (12) electrical metallic tubing, (14) bracket (15), and octagonal junction box (16) in FIG. 3 are metallic, electroconductive, and grounded, and any faulty wiring that makes contact with these will cause a fault in the alarm system. The typical location in which termination devices are located in modern alarm system devices is either within an octagonal junction box (16) or within the junction box (12) on the conduit (13). The termination device in the present invention is located, in most embodiments, on the backplate (10) within the peripheral system device (9) itself, which is nonconductive and does not present this risk. This invention thus greatly decreases the risk of "short circuit" faults.

Figure 4:
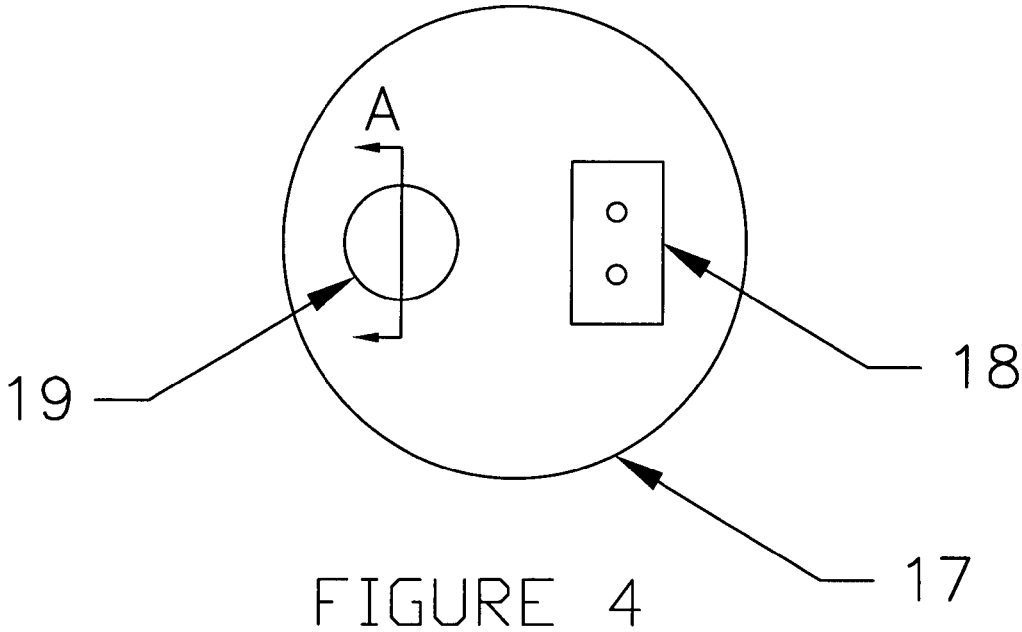
FIG. 4 is a top view of the proposed invention.

FIGS. 4, 5, 6, and 7 depict three possible embodiments of the present invention. FIG. 4 shows the typical underside of a peripheral system component (17). A terminal block (18) which receives the signal wire connections is located somewhere on the underside of the peripheral system component. (17) These embodiments of the present invention also feature a compartment (19) for a termination device elsewhere on the underside of the peripheral system component. (17)

Figure 5:
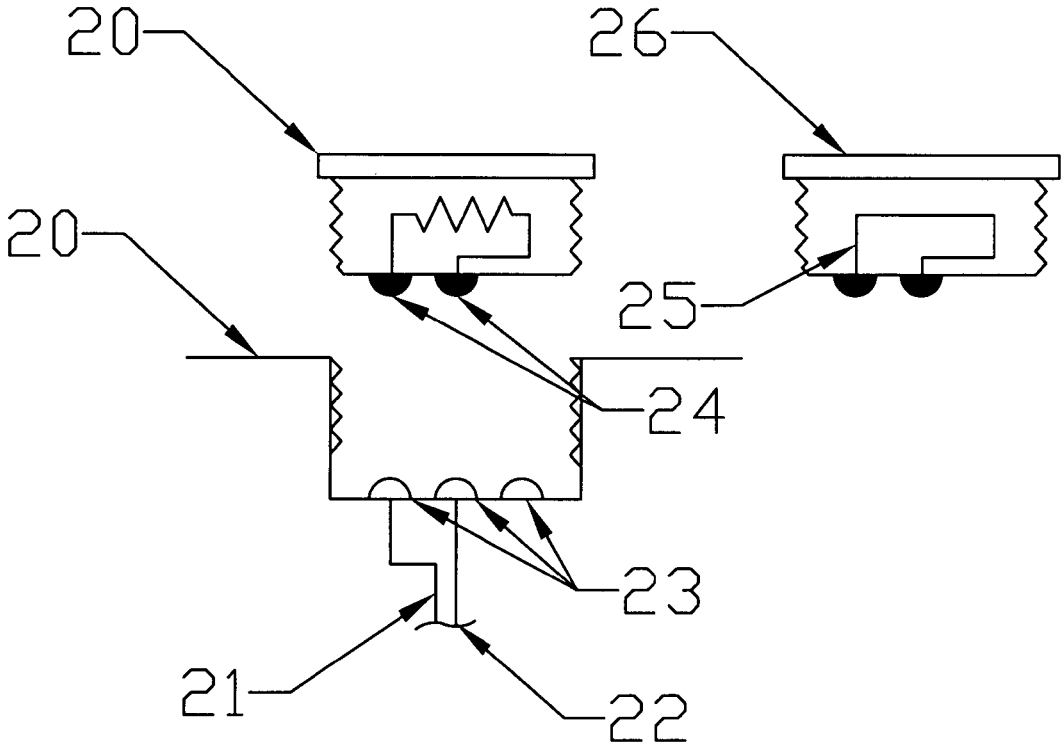
FIG. 5 is a cross section of the proposed invention taken alone section line A-A, employing a threaded cartridge embodiment of the invention.

FIG. 5 depicts an embodiment of the invention in which the termination device (20) is threaded and inserted into a threaded compartment, (21) much like a modern light bulb. Where termination is required, a terminating device (20) is inserted into the compartment, and electrical contacts (24) on the terminating device (20) engage similar electrical contacts (23) in the compartment (19). Signal wiring (21) thus connected to the electrical contacts (24) on the termination device (20) lead back to the protection loop (22) through the terminal block (18) on the underside of the peripheral system device (17). Where termination is not necessary, as in any intermediate peripheral system devices, a pass-through cartridge (26) which has a short-circuit (25) in place of the termination device is installed in the compartment. (19)

Figure 6:
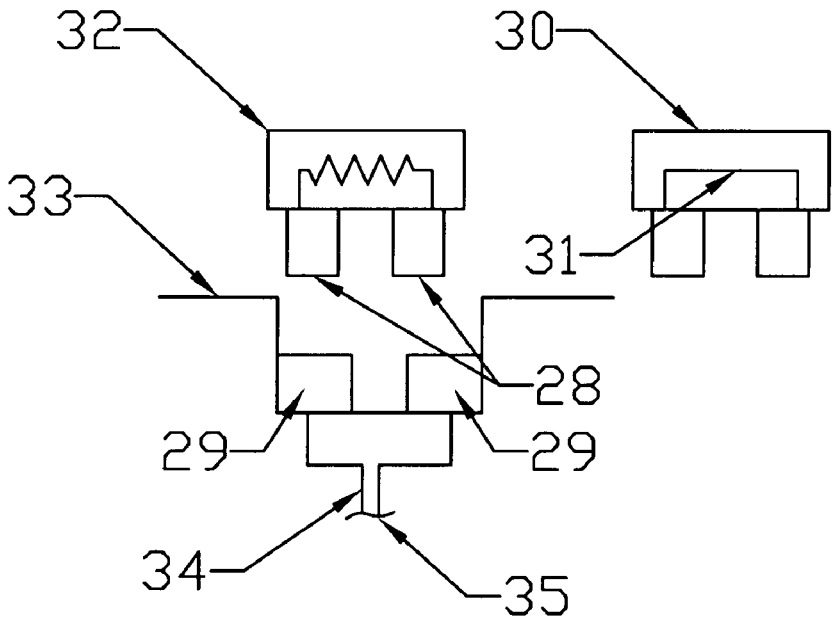
FIG. 6 is a cross section of the proposed invention taken along section line A-A, employing a jumper embodiment of the invention.

FIG. 6 depicts an embodiment of the invention similar to that of FIG. 5, but in this embodiment, a terminating jumper (32) is used to terminate the protection loop (35). The jumper makes electrical contact by means of a pair of blades (28) which contact a two-pronged receptacle (29) within the compartment (19). Like the previous embodiment, devices can be fitted with a pass-through jumper (30) in which the two blades (28) are connected to one another by a short circuit (31). The jumpers are connected to the terminal block (18) and thus the rest of the system by signal wiring (34).

Figure 7:
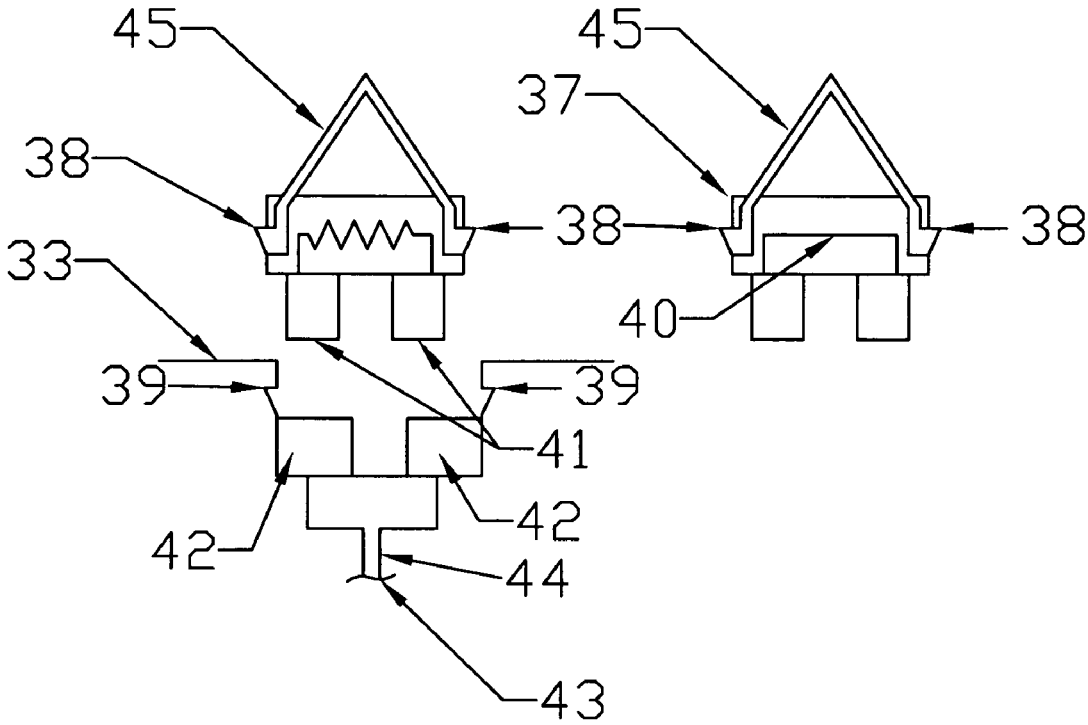
FIG. 7 is a cross section of the proposed invention taken along section line A-A, employing a snap-on cartridge embodiment of the invention.

FIG. 7 depicts an embodiment of the invention similar to that of FIGS. 5 and 6, but in which the terminating device is housed in a snap-on cartridge (37). This device makes connection by a set of leads (41) connecting to a receptacle (42) attached to signal wiring (34) similar to those of FIG. 6. The enclosure of the snap-on cartridge, however, is fitted to the compartment (19) and locks into it by means of a set of protrusions (38) which engage notches (39) within the compartment. A mechanism (45) for withdrawing the protrusions (38) and removing the cartridge (37) is also present. A pass-through cartridge employing a short-circuit (40) may be used where the protection loop (43) is not to be terminated.

As an alternative to removable cartridges, a potentiometer, a dual in-line package device connected to varying termination devices, or similar adjustable device could be installed in the housing (9) of the peripheral system device, allowing the installer to easily change the termination device value at the peripheral system device.

What is claimed is:

1. A system for terminating an alarm system signal circuit, the system comprising:

a peripheral component which has a terminal block to connect to the alarm system signal circuit;

a compartment in the peripheral system component wherein the compartment has electrical contacts; and a termination device that reversibly inserts in the compartment wherein the termination device inserts in and removes from the compartment to reversibly connect and disconnect the termination device to the peripheral component and further wherein the termination device has electrical contacts that contact the electrical contacts of the compartment if the termination device is connected to the peripheral component.

2. The system of claim 1 wherein the terminal block and the compartment are located on a same side of the peripheral component.

3. The system of claim 1 further comprising:

first threads connected to the compartment and second threads connected to the termination device wherein the first threads connect to the second threads to connect the termination device to the peripheral component.

4. The system of claim 1 further comprising:

a blade that extends from the termination device to contact the compartment wherein the electrical contacts of the termination device contact the electrical contacts of the compartment if the blade contacts the compartment.

5. The system of claim 1 further comprising:

a prong that extends from the compartment to contact the termination device wherein the electrical contacts of the termination device contact the electrical contacts of the compartment if the prong contacts the termination device.

6. The system of claim 1 further comprising:

a cartridge that replaces the termination device in the compartment of the peripheral component wherein the cartridge has a circuit that transmits current from the electrical contacts of the peripheral component.

7. The system of claim 1 further comprising:

a protrusion that extends from a first side of the termination device wherein the protrusion inserts in a notch in the compartment to connect the termination device to the peripheral component and further wherein the electrical contacts of the termination device are located on a second side of the termination device that is substantially perpendicular to the first side of the termination device.

8. The system of claim 1 further comprising:

a handle that extends from an opposite side of the termination device relative to the electrical contacts of the termination device.

9. A system for terminating an alarm system signal circuit, the system comprising:

a peripheral component having a terminal block to connect to the alarm system signal circuit wherein the peripheral component has a receptacle having electrical contacts and a notch;

a first cartridge that has electrical contacts wherein the first cartridge connects to the receptacle for the electrical contacts of the first cartridge to receive current from the electrical contacts of the receptacle; and a protrusion that extends from the first cartridge to insert in the notch in the receptacle wherein insertion of the protrusion in the notch connects the first cartridge to the peripheral component.

10. The system of claim 9 wherein the first cartridge is a potentiometer that varies a resistance for the current.

11. The system of claim 9 wherein the first cartridge is a dual inline package device connected to additional termination devices.

12. The system of claim 9 further comprising:

a second cartridge that replaces the first cartridge in the receptacle of the peripheral component wherein the second cartridge has a different resistance for the current relative to the first cartridge.

13. The system of claim 9 further comprising:

leads that extend from a first side of the termination device to contact the receptacle wherein the electrical contacts of the termination device contact the electrical contacts of the receptacle if the leads contact the receptacle and further wherein the protrusion extends from a second side of the termination device which is substantially perpendicular to the first side of the termination device.

14. The system of claim 9 further comprising:

a handle that extends from an opposite side of the termination device relative to the electrical contacts of the termination device.

15. A method for terminating an alarm system signal circuit, the method comprising the steps of:

connecting a terminal block of a peripheral component to the alarm system signal circuit wherein the peripheral component has a receptacle having electrical contacts and first threads; and reversibly connecting a termination device having electrical contacts and second threads to the receptacle wherein connection of the first threads to the second threads connects the termination device to the receptacle and further wherein connecting the termination device to the receptacle contacts the electrical contacts of the termination device to the electrical contacts of the receptacle wherein disconnecting the first threads from the second threads disconnects the termination device from the receptacle and further wherein disconnecting the termination device from the receptacle removes the electrical contacts of the termination device from contact with the electrical contacts of the receptacle.

16. The method of claim 15 further comprising the step of:

removing the termination device from the receptacle and connecting an additional termination device to the receptacle wherein the additional termination device has a different resistance to current from the alarm system signal circuit relative to the termination device.

17. The method of claim 15 further comprising the step of:

removing the termination device from the receptacle and connecting a pass-through cartridge to the receptacle wherein the pass-through cartridge has a circuit that transmits current from the peripheral component.

18. The method of claim 15 further comprising the step of:

contacting a blade that extends from termination device with the receptacle wherein the blade contacts the receptacle to convey current to the termination device from the peripheral component and further wherein the blade extends from a different side of the termination device relative to the second threads.

19. The method of claim 15 further comprising the step of:

contacting a prong that extends from the receptacle with the termination device wherein the prong contacts the termination device to convey current to the termination device from the peripheral component.

20. The method of claim 15 further comprising the step of:

pulling a handle connected to the termination device to remove the termination device from the receptacle.

* * * * *